US005077920A

United States Patent [19]

Farrell

[11] Patent Number: 5,077,920

[45] Date of Patent: Jan. 7, 1992

[54] POWER BROOM ASSEMBLY

[75] Inventor: Eugene A. Farrell, Fishers Landing, N.Y.

[73] Assignee: Cives Corporation, Roswell, Ga.

[21] Appl. No.: 493,738

[22] Filed: Mar. 15, 1990

[51] Int. Cl.[5] ..... E01H 5/09

[52] U.S. Cl. ..... 37/247; 37/251; 37/259; 15/83

[58] Field of Search ..... 37/209-211, 37/228, 238, 247, 256, 259, 244, 248, 251; 15/83, 84; 37/244, 248, 251

[56] References Cited

U.S. PATENT DOCUMENTS

| | | | |
|---|---|---|---|
| 478,942 | 7/1892 | Pease | 37/244 |
| 1,642,895 | 9/1927 | Robinson et al. | 37/238 X |
| 2,175,542 | 10/1939 | Robarge | 37/248 X |
| 2,809,389 | 10/1957 | Collins et al. | 37/244 X |
| 3,321,851 | 5/1967 | Fisher | 37/209 X |
| 3,735,510 | 5/1973 | Godfrey et al. | 37/247 X |

FOREIGN PATENT DOCUMENTS

| | | | |
|---|---|---|---|
| 479828 | 1/1952 | Canada | 37/259 |
| 1018444 | 10/1957 | Fed. Rep. of Germany | 37/248 |

*Primary Examiner*—David H. Corbin
*Assistant Examiner*—Arlen L. Olsen
*Attorney, Agent, or Firm*—Burns, Doane, Swecker & Mathis

[57] ABSTRACT

A power broom assembly includes a vehicle, a rotatable broom mounted to the front of the vehicle, and an airblast assembly mounted to the front of the vehicle above the broom to suck up an overspray of material which has been swept up by the broom. An airblast assembly for use in the power broom assembly includes a casing, a cross flow blower in the casing, and at least two outlets in the casing which are selectively openable and closeable by flexible wall portions which are movable radially inwardly and outwardly to substantially change the inner contour of the casing. A drive system of the power broom assembly includes a first transmission unit which has first and second output shafts, and a second transmission unit which includes an input shaft. At least the first and second output shafts of the first transmission unit and the input shaft of the second transmission unit are aligned along a single axis.

30 Claims, 4 Drawing Sheets

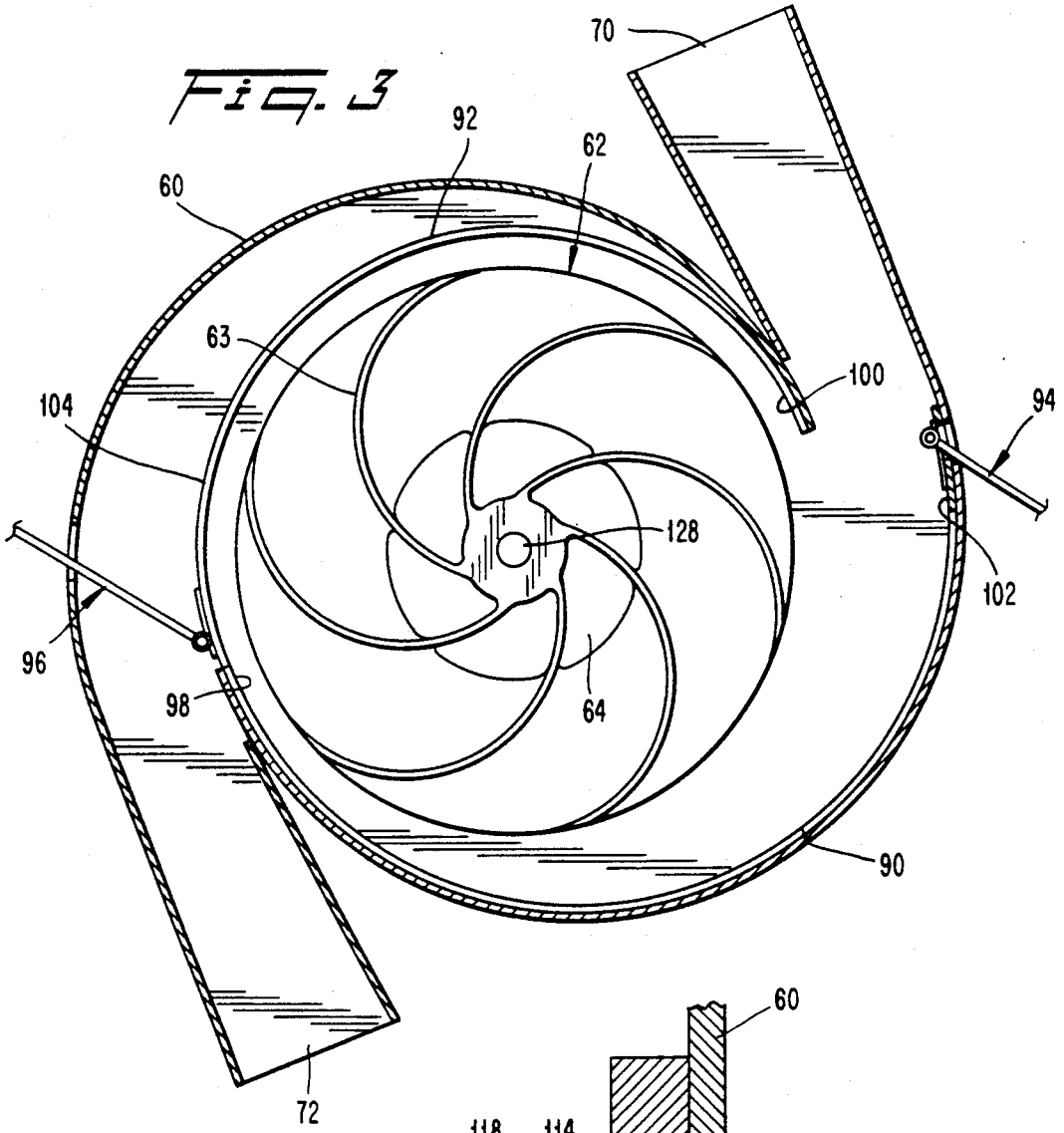
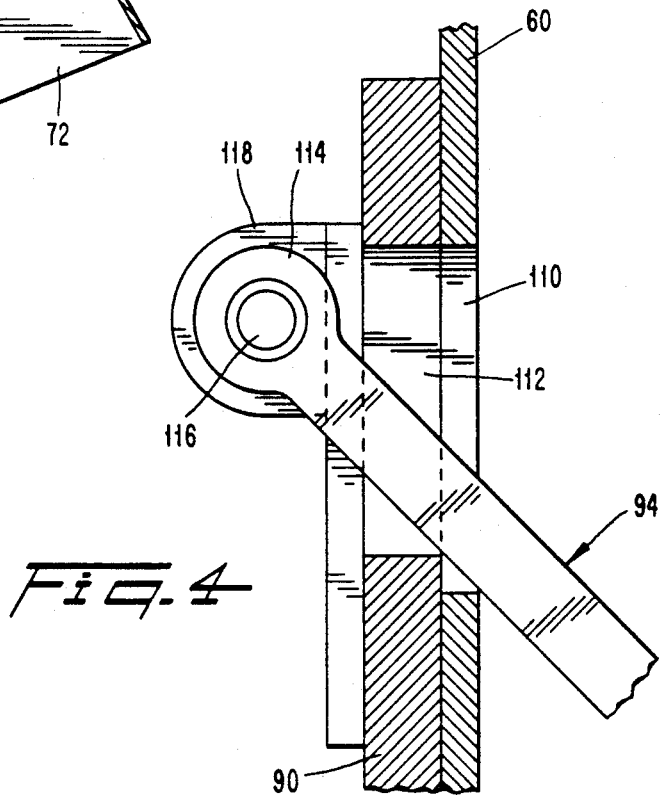
Fig. 4

POWER BROOM ASSEMBLY

FIELD OF THE INVENTION

The present invention relates to devices useful for sweeping material such as snow from surfaces such as airport runways. More particularly, the present invention relates to power brooms which include airblast assemblies.

BACKGROUND AND SUMMARY OF THE INVENTION

Several types of the device which are adapted to remove material such as snow from surfaces are known in the prior art. For example, U.S. Pat. No. 1,642,895 granted to Robinson et al. discloses a snow removing machine which includes a motor vehicle chassis which has a rotating brush disposed at the front end thereof. A tube runs from the brush to a tank mounted in the rear end of the chassis, and snow from the brush is propelled through the tube pneumatically by the action of a fan contained in the body of the chassis. However, due to the disparate locations of the broom and the fan, the mechanisms which drive the broom and the fan are necessarily complicated, thereby requiring substantial maintenance time and cost. Also, the broom is driven by a gear drive and the fan is driven by a belt drive, which are not the most highly efficient driving mechanisms and which therefore result in reduced power outputs.

Other snow sweeping devices are known which are adapted to be towed behind a vehicle. These devices, such as the SWEEPSTER SMI/Sicard Remanufacture and the SWEEPSTER Model 2900, are self-contained hydrostatic drive devices which include a rotating brush and an airblast to brush and blow snow off of a surface. However, these devices each have the disadvantage, among others, that the vehicle which pulls the device tends to pack down snow under its tires as it goes, thereby making it more difficult for the device to brush and blow all of the snow off of the surface. Also, although the hydrostatic drive devices are very efficient, they are still relatively complicated and involve hydraulic fluid lines which can often rupture and spill fluid on the surface which is being swept. This is particularly undesirable when the surface being swept is an airport runway.

Still other devices are known, such as SWEEPSTER Models 3000/3100 and S3100B, in which a sweeper brush is attached to the front of a vehicle. These devices also may include airblasts attached to the rear or side of the vehicle to blow snow off of a surface in addition to sweeping it off. Because these devices locate a sweeper brush in front of the vehicle, these devices eliminate the problem of the vehicle packing down snow with its tires before the snow is swept. Unfortunately, though, the frontal brush location gives rise to another problem, because the sweeper brush tends to generate a large amount of overspray, i.e. loose snow which is thrown up in front of the vehicle by the sweeper brush, which can at times severely obscure the vision of an operator of the vehicle. In addition, both the brushes and the airblasts on these devices are powered by hydrostatic drives, which again involve the problems of complexity and possible hydraulic line rupture.

Finally, U.S. Pat. No. 3,735,510 granted to Godfrey et al. discloses a device for removing snow which may include a rotary brush mounted on the front of a vehicle and a tube which delivers high pressure air to the underside of the brush. The high pressure air serves to lift snow from a surface being cleared so that the brush can displace the snow from the path of the vehicle. Like the devices above which carry frontal brushes, this device also has the problem of tending to produce a large amount of overspray, especially since the high pressure air breaks up the snow as the brush contacts the snow, which makes it easier for the snow to be thrown up into the air.

In view of the above, it is an object of the present invention to provide an improved power broom assembly which is readily capable of sweeping materials such as snow from surfaces such as airport runways.

A further object of the present invention is to provide a power broom assembly which includes a broom drive system which is relatively powerful and which experiences relatively minimal vibration.

It is a further object of the present invention to provide a power broom assembly which has a relatively high reliability and which is relatively easy to maintain.

It is a further object of the present invention to provide a power broom assembly which does not pack down the material which is being swept before the material can be swept.

It is a further object of the present invention to provide a power broom assembly which produces very little overspray to obscure the vision of an operator of the broom assembly.

Another object of the present invention is to provide a power broom assembly which is capable of selectively displacing material in its path toward either its left or its right side.

The above objects as well as other objects not specifically enumerated are accomplished by a power broom assembly in accordance with the present invention. The power broom assembly of the present invention includes a vehicle, a rotatable broom mounted to the front of the vehicle, and an airblast assembly mounted to the front of the vehicle above the broom to suck up an overspray of material which has been swept up by the broom.

The objects of the invention are also accomplished by a power broom assembly which includes a power driven broom and an airblast assembly including a casing, an impeller of a cross flow blower inside the casing, an inlet in the casing to allow entry of both air and an overspray from a broom of the power broom assembly, at least two outlets in the casing to allow the air and overspray to be blown out of the cross flow blower, and means for selectively opening and closing the casing outlets. The means for selectively opening and closing the casing outlets includes at least two flexible wall portions which are movable radially inwardly and outwardly to substantially change the inner contour of the casing about the cross flow blower to selectively close and open the casing outlets.

The objects of the present invention are further accomplished by a power broom assembly which includes a power driven broom and a drive system for driving the power driven broom which includes first and second transmission units adjacent a central portion of the power broom assembly. The first transmission unit includes an input shaft and two output shafts. A first output shaft is drivingly connected to an airblast assembly of the power broom assembly and the second output shaft is drivingly connected to an input shaft of the second transmission unit. The second transmission unit includes an input shaft drivingly connected to the second output shaft of the first transmission unit and an output shaft drivingly connected to a broom of the power broom assembly. At least the first and second output shafts of the first transmission unit and the input shaft of the second transmission unit are substantially aligned along a single axis.

BRIEF DESCRIPTION OF THE DRAWINGS

The preferred embodiments of the present invention will be described in greater detail with reference to the accompanying drawings, wherein like members bear like reference numerals and wherein:

FIG. 3 is a top cutaway view of the airblast assembly;

FIG. 4 is a detail view of the means for selectively opening and closing the airblast assembly casing outlets of FIG. 3.

DETAILED DESCRIPTION

Figure 1:
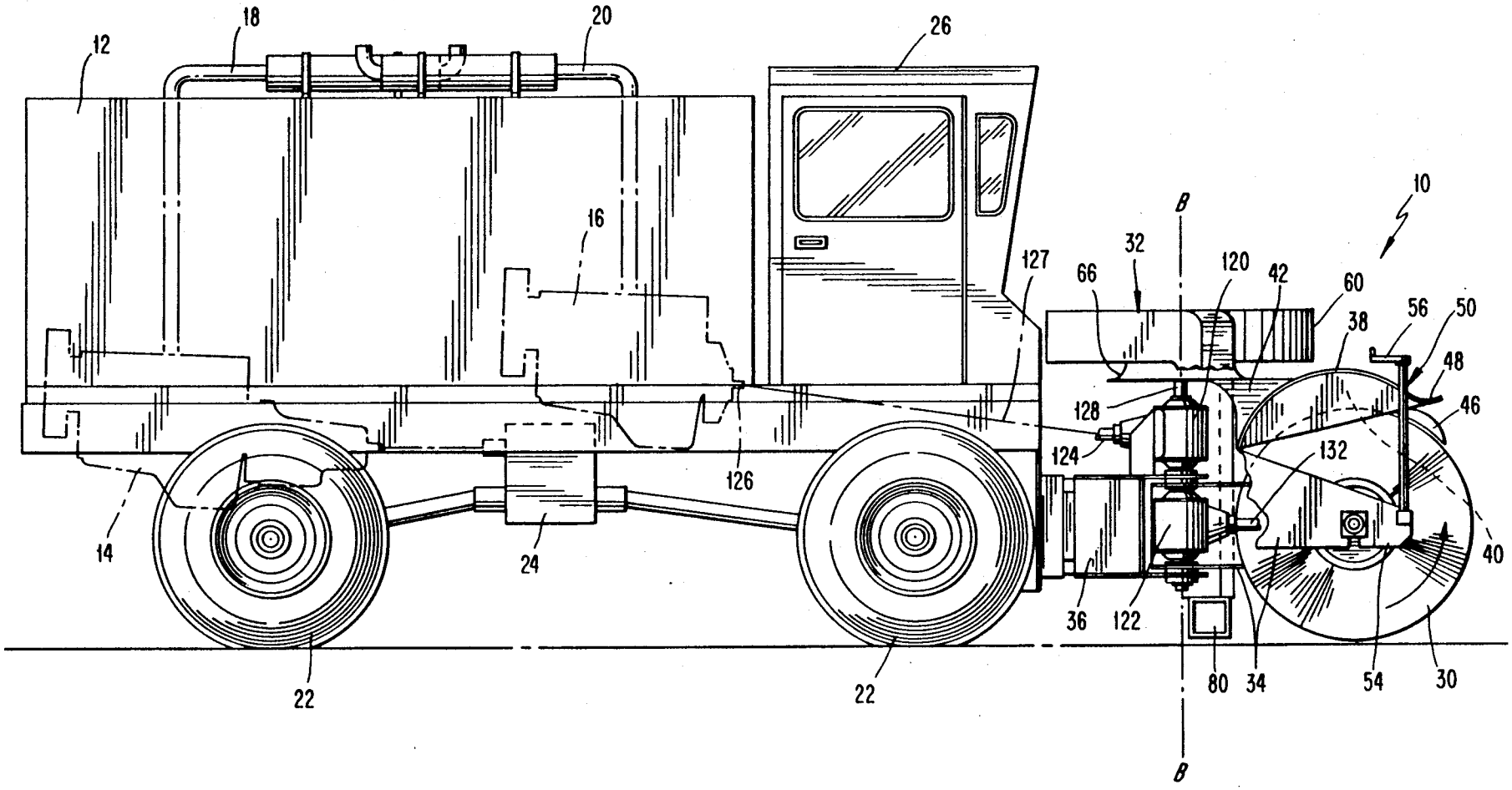
FIG. 1 is a partially cutaway side view of a vehicle with a power broom assembly of the present invention arranged thereon.

With reference to FIGS. 1-5, a power broom assembly 10 in accordance with an embodiment of the present invention is arranged on a vehicle 12 having a carrier engine 14 and a sweeper engine 16. Exhaust systems 18 and 20 extend above the vehicle 12 and carry exhaust gases from the carrier engine 14 and the sweeper engine 16 respectively. The carrier engine 14 is the main drive engine of the vehicle 12, and it is drivingly connected to wheels 22 through a conventional transmission 24. The operation of the sweeper engine 16 will be discussed hereinbelow. The vehicle 12 further includes a cab 26 in which an operator of the vehicle 12 sits to drive the vehicle 12 and control the operation of the power broom assembly 10.

The power broom assembly 10 includes a rotatable broom 30 mounted in front of the vehicle 12. As seen from FIGS. 1 and 2, the broom 30 is rotatably mounted to a lower bridge assembly 34 such that the broom 30 is rotatable about a horizontal axis A—A. As will be discussed in more detail hereinbelow with reference to FIG. 5, the lower bridge assembly is rotatably mounted to an upper bridge assembly 36, which is mounted to the front of the vehicle 12, such that the lower bridge assembly 34 is rotatable about a vertical axis B—B. This allows the lower bridge assembly 34 and the broom 30 to be turned at an angle to the path of the vehicle 12, which has the effect of enabling the power broom assembly 10 to push all the material in its path to one side or the other, which is important when a very wide surface is being cleared. As seen from FIGS. 1 and 2, the lower bridge assembly 34 has rotatably mounted thereto about axis C—C a partial cover 38 which covers a portion of the upper surface of the broom 30. As a result, a space 40 normally exists between the upper surface of the broom 30 and the partial cover 38.

An airblast assembly 32 is mounted to the front of the vehicle 12 above the broom 30 to suck up an overspray of material which is swept up by the broom 30. As can be seen in FIG. 1, an overspray inlet 42 of the airblast assembly 32 is connected to the space 40. Overspray from the front of the broom 30 is sucked into the space 40, and thereby into the airblast assembly 32, with the aid of an airfoil system 44 mounted at the forward edge of the space 40. The airfoil system 44 includes a first airfoil 46 which is mounted to the lower bridge assembly 34 such that it is in a fixed position relative to the central axis A—A of the broom 30, and a second airfoil 48 which is connected with the partial cover 38. In a preferred embodiment, the second airfoil 48 is formed in one piece with the partial cover 38 and forms the leading edge thereof. Together the first and second airfoils 46,48 cooperate to create a pressure inside the space 40 which is lower than the pressure in front of the first and second airfoils 46,48. This negative pressure, together with the suction from the airblast assembly 32, sucks overspray which is in front of the broom 30 into the space 40 past the airfoil, and through the space 40 into the overspray inlet 42.

The lower bridge assembly 34 includes a crank assembly 50,52 on either longitudinal end of the brush 30 The crank assemblies 50,52 are rotatably mounted at their lower ends to a fork 54 of the lower bridge assembly 34, and are rotatably mounted at their upper ends to the partial cover 38. The rotational connections between the crank assemblies 50,52 and the partial cover 38 are screw connections, such that turning of crank handles 56,58 results in raising or lowering of the front edge of the partial cover 38 by rotation of the axis C—C. Additionally, the crank assemblies 50,52 are rotatably connected to the first airfoil 46 at the respective ends of the first airfoil. Therefore, the first airfoil 46 remains in a fixed position relative to the central axis A—A of the broom 30 when the crank assemblies 50,52 are turned to raise or lower the front edge of the partial cover 38. The raising and lowering of the front edge of the partial cover 38 thereby changes the distance between the first and second airfoils 46, 48, and allows an operator to adjust the suction generated by the airfoil system 44.

Figure 2:
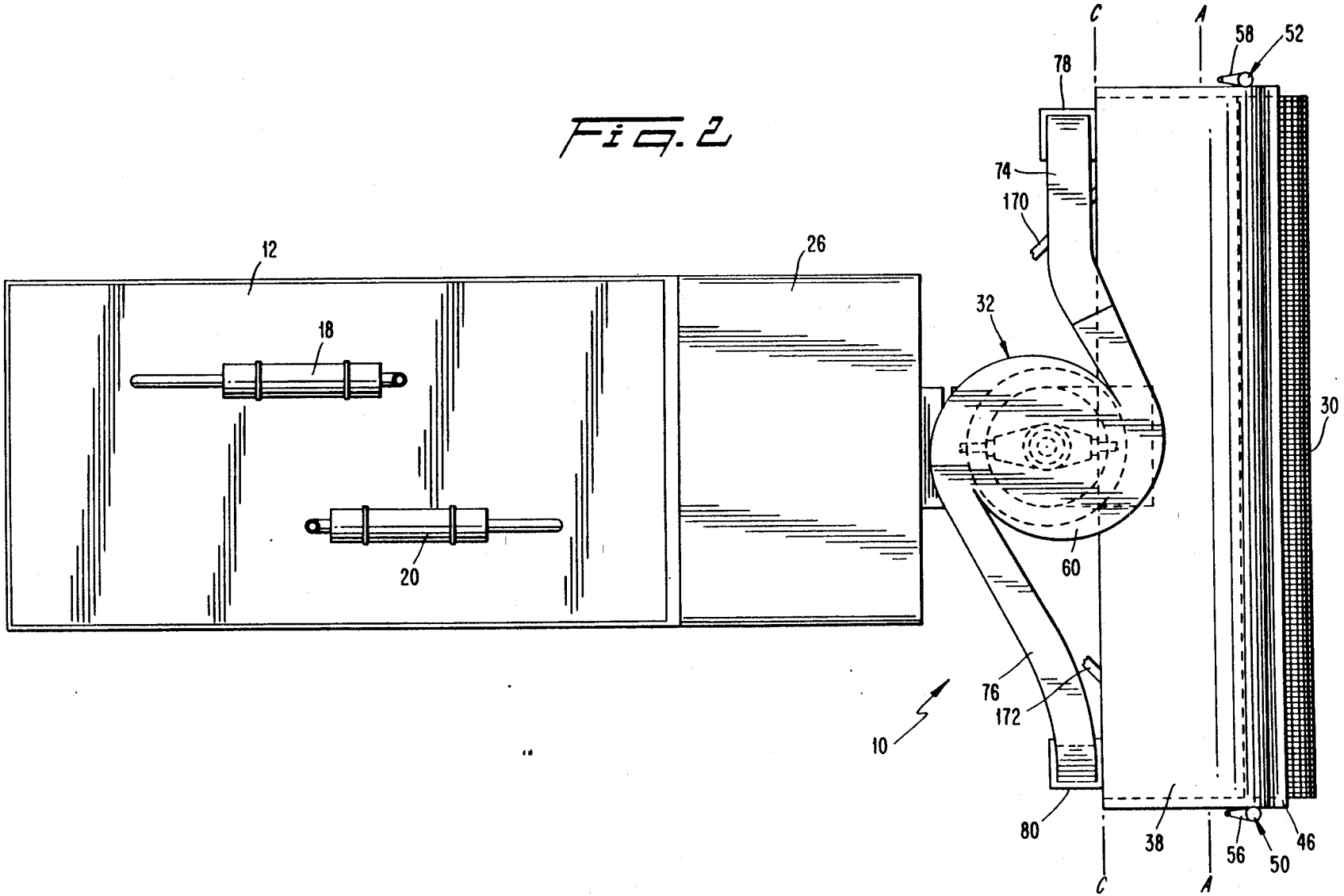
FIG. 2 is a top view of the vehicle and power broom assembly of FIG. 1.

With reference to FIGS. 1-4, the structure and operation of the airblast assembly 32 will now be explained. The airblast assembly 32 is mounted to the front of the vehicle 12 above the broom 30. The airblast assembly 32 includes a casing 60 which, as seen in detail in FIG. 3, houses a cross flow blower 62. The casing 60 further includes an inlet 64 which is connected to the overspray inlet 42 for sucking overspray from the broom 30, and which is connected to an air inlet 66 (see FIG. 1) which supplies air. As seen in FIG. 3, the inlet 64 is located radially centrally of the cross flow blower 62. The casing 60 also includes two casing outlets 70,72 which allow the overspray and air from the overspray and air inlets 42,66 to be blown out of the cross flow blower 62 in a preselected direction as will be described further. Each of the casing outlets 70,72 is connected to an outlet tube 74,76, which in turn includes an outlet opening 78,80 near ground level at a side of the power broom assembly 10 behind the broom 30. The outlet openings 78,80, which are shown in FIGS. 1 and 2, are located behind the broom 30 near ground level so that the air/overspray mixture which is blown out by the cross flow blower 62 will be blown out of the path of the vehicle 12, and will further blow away material such as snow which is lying close to the side of the vehicle 12.

The impeller 63 of the cross flow blower 62 is driven by a shaft 128 connected to a transmission unit 120. The impeller 63 may be made of any suitable material, but a lightweight composite material is preferred, and a polycarbonate composite material is most preferred. The use of a lightweight composite material in the impeller 63 reduces the weight of the impeller 63 without reducing its strength. This allows the use of less power to drive the cross flow blower 62 at a given speed, or allows the cross flow blower 62 to be driven at a higher speed with a given power input.

As seen from FIGS. 3 and 4, the airblast assembly 32 includes means for selectively opening and closing the casing outlets 70,72. The opening and closing means includes two flexible wall portions 90,92 and a rod assembly 94,96 attached to each of the flexible wall portions 90,92, respectively. The flexible wall portions 90,92 are made of a flexible polymer and each have a first end 98,100 fixed to an inside wall of the casing 60, and a second end 102,104 rotatably attached to a respective rod assembly 94,96. As seen from FIG. 4, which is a more detailed view of the connection between the flexible wall portion 90 and the rod assembly 94, the rod assembly 94 extends through a slot 110 in the casing 60 and a slot 112 in the flexible wall portion 90. A head 114 of the rod assembly 94 is rotatably attached by a pin 116 to a plate 118 which is fixed to the flexible wall portion 90 by any conventional means. A similar attachment (not shown) is used on the flexible wall portion 92.

In FIG. 3, the casing outlet 70 is open and the casing outlet 72 is closed, due to the positioning of the flexible wall portion 90 against the inside wall of the casing 60 and the positioning of the flexible wall portion 92 substantially coextensive with the first end 98 of the flexible wall portion 90. In order to change the outlet opening configuration, the rod assembly 94 is pushed into the casing 60 until the second end 102 of the flexible wall portion 90 is generally continuous or coextensive with the first end 100 of the flexible wall portion 92, and the rod assembly 96 is pulled out of the casing 60 until the second end 104 of the flexible wall portion 92 is substantially in contact with the casing 60. As the rod assembly 94 is pushed into the casing 60, for example, it rotates relative to the flexible wall portion 90 around the pin 116, and it moves within the slots 110,112. The flexible wall portion 90 is thereby moved radially inwardly within the casing 60. At approximately the same time, the flexible wall portion 92 is moved radially outwardly within the casing 60 to substantially change the inner contour of the casing 60 about the cross flow blower 62 and to thereby open the casing outlet 72 and close the casing outlet 70. It should be noted that the rod assemblies 94,96 may be simultaneously actuated by any well known actuation means, such as a cam and lever assembly, a piston and lever assembly, or an interconnecting link assembly, or the rod assemblies may be actuated manually by an operator of the power broom assembly 10.

The selective opening and closing of the casing outlets 70,72 is an important feature of the present invention, since it allows the overspray and air to be blown in the desired direction and may be configured to conform to the direction in which the broom 30 sweeps material which is in the path of the vehicle 12.

For example, if the broom 30 is rotated clockwise through movement of the lower bridge assembly 34 from the position shown in FIG. 2, the broom 30 will urge material such as snow which is in the path of the vehicle 12 toward the right of the vehicle 12. It is then desirable to close the casing outlet 70 and to open the casing outlet 72, so that the overspray and air blown by the cross flow blower 62 will be blown to the right of the vehicle 12 and will help to blow away material which is lying on the right side of the vehicle 12. If the lower bridge assembly 34 and the broom 30 are rotated counterclockwise from the position shown in FIG. 2, the orientation of the flexible wall portions 90,92, and hence the open casing outlet can be reversed. Also, the flexible wall portions 90,92 can be moved to positions wherein each of the flexible wall portions 90,92 is located halfway between the open and the closed positions. When this is true, both of the casing outlets 70,72 are partially open, and the overspray and air from the cross flow blower 62 will be blown to both sides of the vehicle 12. Such a casing outlet configuration could be useful, for example, when the broom 30 is in the position shown in FIG. 2, i.e., when it is perpendicular to the path of the vehicle 12.

Figure 5:
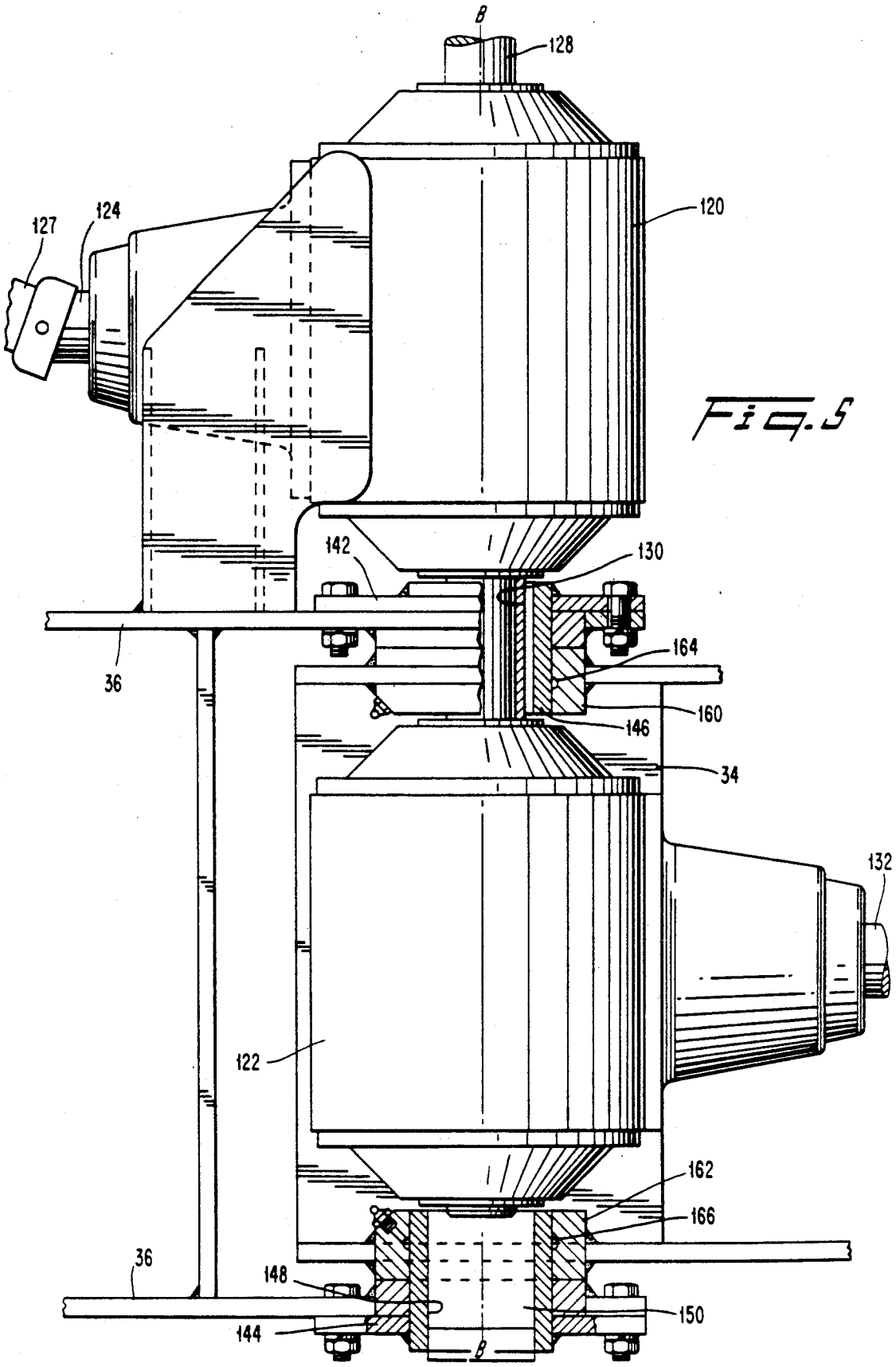
FIG. 5 is a side view of first and second transmission units and lower and upper bridge assemblies for the drive assembly of the power broom.

As seen from FIGS. 1 and 5, the broom 30 and the cross flow blower 62 are driven by the sweeper engine 16 through two transmission units, a gearbox 120 and a gearbox 122. The first transmission unit, the gearbox 120, includes an input shaft 124 (see FIG. 5) which is drivingly connected to an output shaft 126 of the sweeper engine 16, as is schematically indicated at 127 in FIG. 1. The gearbox 120 includes a first output shaft 128 which is directly connected to the impeller 63 of the cross flow blower 62, and a second output shaft 130 which also serves as an input shaft to the second transmission unit, the gearbox 122. The gearbox 122 includes an output shaft 132 which is drivingly connected to the broom 30 by well known gearing means. In order to reduce the complexity of the driving system, the shafts 128,130 of the first and second transmission units are aligned along a single common axis B—B. This arrangement also permits the broom 30 to be rotated about the transmission shafts' axis, axis B—B, as will be discussed below, further reducing the complexity of the overall system.

As seen from FIG. 1, the first transmission unit, the gearbox 120, is spaced vertically from the output shaft of the sweeper engine 16 by only a relatively small distance. Therefore, the driving connection 127 between the sweeper engine 16 and the gearbox 120 is only slightly angled relative to each of the output shaft 126 of the sweeper engine 16 and the input shaft 124 of the gearbox 120, and thus experiences a minimal amount of vibration. Also, since both the airblast assembly 32 and the broom 30 are driven by a single engine 16 and drive shaft 126, and since both of the gearboxes 120,122 are located along a single vertical axis B—B on a central axis of the power broom assembly (see FIG. 2), very little power is lost between the sweeper engine 16 and the output shafts 128,132. Additionally, the overall complexity of the broom and airblast assembly drive system is low, and the drive system includes no hydrostatic or hydraulic elements. This arrangement greatly reduces the maintenance costs and increases the reliability of the overall drive system.

It should be noted that, while not shown in the drawings, it is within the scope of the present invention to provide clutch units between the cross flow blower 62 and the gearbox 120, between the gearbox 120 and the gearbox 122, and/or between the gearbox 122 and the broom 30. Such clutch units would enable either the airblast assembly 32 or the broom 30 to be operated independently.

With reference to FIGS. 1 and 5, the first transmission unit, the gearbox 120, is fixedly mounted to a flange 140 of the upper bridge assembly 36. Also, plates 142,144 are bolted to the upper bridge assembly 36, and cylindrical collars 146,148 are welded to the plates 142,144. The shafts 130 and 150 are held rotatively within the cylindrical collars 146,148. Additionally, collars 160,162 of the lower bridge assembly 34 are mounted around the cylindrical collars 146,148 and are held there rotatably so that the lower bridge assembly 34 and the broom 30 are rotatable about the vertical axis B—B. Also, grease grooves 164,166 are located in the collars 160,162, respectively, to carry grease and thereby reduce rotational friction between the collars 160,162 and the cylindrical collars 146,148. The lower bridge assembly 34 and the broom 30 can be rotated about the axis B—B by the action of actuation levers 170,172 which are shown generally in FIG. 2. The actuation levers 170,172 can be rotatably attached at any point on or near the left and right hand sides of the lower bridge assembly 34, respectively, and can be operated by any conventional actuation means, such as piston assemblies.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A power broom assembly, comprising:

a vehicle movable in a first direction to define a path of said vehicle;

broom means, mounted on a front of said vehicle, for sweeping material, which is in said path, to a side of said vehicle ahead of said broom means;

an airblast means, mounted to a front of said vehicle above plane which is parallel to said first direction and which is tangent to an uppermost surface of said broom means, for sucking up overspray of material which is generated by said sweeping of said broom means.

2. A power broom assembly according to claim 1, wherein said airblast means includes a cross flow blower and at least one outlet extending tangentially to said cross flow blower to allow air and any overspray to be blown out of said cross flow blower, said outlet being located ahead, in said first direction, of front wheels of said vehicle to maintain a clear path ahead of said front wheels.

3. A power broom assembly according to claim 2, wherein an impeller of said cross flow blower is formed from a polycarbonate composite material.

4. A power broom assembly according to claim 1, further including:

an engine; and first and second transmission units mounted to the front of said vehicle, said first transmission unit including an input shaft drivingly connected to said engine, a first output shaft drivingly connected to said airblast means, and a second output shaft drivingly connected to said second transmission unit to act as an input shaft of said second transmission unit, said second transmission unit also including an output shaft drivingly connected to said broom means at least said first and second output shafts of said first transmission unit being substantially aligned along a single axis.

5. A power broom assembly according to claim 4, wherein said broom means is mounted to a lower bridge assembly such that said broom means is rotatable about a horizontal axis, and said lower bridge assembly is mounted to the front of said vehicle such that said lower bridge assembly is rotatable about said single axis defined by said first and second output shafts of said first transmission unit.

6. A power broom assembly according to claim 5, wherein said second transmission unit is mounted rigidly to said lower bridge assembly, and said first transmission unit is mounted rigidly to an upper bridge assembly mounted on the front of said vehicle.

7. A power broom assembly according to claim 4, wherein said first and second transmission units are located at a central location of said vehicle.

8. A power broom assembly according to claim 1, further including:

a first airfoil mounted to the front of said vehicle near a surface of said broom means;

a partial cover surrounding an upper portion of said broom means; and a second airfoil on said partial cover, wherein an inlet of said airblast means opens into a space between said broom means and said partial cover, and said first and second airfoils cooperate to create a pressure inside said space which is lower than a pressure in front of said first and second airfoils so that overspray is sucked into and through said space into said inlet.

9. A power broom assembly according to claim 8, wherein said first airfoil is mounted to said vehicle in a fixed position relative to a central axis of said broom means and said partial cover is rotatably mounted to said vehicle.

10. A power broom assembly according to claim 9, wherein said second airfoil is moveable relative to said first airfoil.

11. A power broom assembly according to claim 9, further including:

means for moving said partial cover toward and away from said broom means to adjust the distance between said first and second airfoils.

12. A power broom assembly according to claim 11, wherein said means for moving said partial cover includes at least one crank assembly rotatably mounted to the front of said vehicle and to said partial cover.

13. A power broom assembly according to claim 1, wherein said broom means is mounted to a lower bridge assembly such that said broom means is rotatable about a horizontal axis, said lower bridge assembly being mounted to the front of said vehicle such that said lower bridge assembly is rotatable about a vertical axis.

14. A power broom assembly, comprising:

a vehicle;

a rotatable broom rotatably mounted to a front of said vehicle; and an airblast assembly mounted to the front of said vehicle above said broom to suck up an overspray of material which has been swept up by said broom, said airblast assembly including a casing, an impeller of a cross flow blower inside said casing, an inlet in said casing located radially centrally of said cross flow blower, at least two outlets in said casing extending tangentially to said cross flow blower to allow said overspray to be blown out of said cross flow blower, and means for selectively opening and closing said casing outlets.

15. A power broom assembly according to claim 14, wherein said casing outlets are connected to outlet tubes, each of said outlet tubes having an outlet opening near ground level to blow air and any overspray to the side of the path of said vehicles, and to further blow away material lying ahead, in a direction of movement of said vehicle, of wheels of said vehicle.

16. A power broom assembly according to claim 14, wherein said means for selectively opening and closing said casing outlets includes at least two flexible wall portions which are moveable radially inwardly and outwardly to substantially change the inner contour of said casing about said cross flow blower and thereby selectively close and open said casing outlets.

17. A power broom assembly according to claim 16, further including:

means for moving said flexible wall portions radially inwardly and outwardly to thereby selectively close and open said casing outlets; and means for interconnecting said moving means such that one of said flexible wall portions is moved radially inwardly by said moving means as another of said flexible portions is moved radially outwardly by said moving means.

18. A power broom assembly, comprising:

a vehicle;

a rotatable broom rotatably mounted to a front of said vehicle;

an airblast assembly mounted to the front of said vehicle above said broom to suck up an overspray of material which has been swept up by said broom;

an engine; and first and second transmission units mounted to the front of said vehicle, said first transmission unit including an input shaft drivingly connected to said engine, a first output shaft drivingly connected to said airblast assembly, and a second output shaft connected to said second transmission unit to act as an input shaft of said second transmission unit, said second transmission unit also including an output shaft drivingly connected to said broom, wherein said input shaft of said first transmission unit is aligned along a single axis with and is spaced vertically from an output shaft of said engine by only a relatively small distance.

19. A power broom assembly, comprising:

a power driven broom; and an airblast assembly comprising:

a casing;

an impeller of a cross flow blower inside said casing;

an inlet in said casing to allow entry of both air and an overspray from the broom of the power broom assembly;

at least two outlets in said casing to allow said air and overspray to be blown out of said cross flow blower; and means for selectively opening and closing said casing outlets, said selective opening and closing means including at least two flexible wall portions which are movable radially inwardly and outwardly to substantially change the inner contour of said casing about said cross flow blower to selectively close and open said casing outlets.

20. A power broom assembly according to claim 19, wherein an impeller of said cross flow blower is formed from a polycarbonate composite material.

21. A power broom assembly according to claim 19, wherein said casing outlets are connected to outlet tubes, each of said outlet tubes having an outlet opening near ground level to blow air and any overspray to the side of the path of said power broom assembly and to further blow away material lying behind said power broom assembly.

22. A power broom assembly according to claim 19, further including:

a first airfoil mounted to the front of said power broom assembly near the surface of said broom;

a partial cover surrounding an upper portion of said broom; and a second airfoil on said partial cover, wherein said airblast assembly inlet opens into a space between said broom and said partial cover, and said first and second airfoils cooperate to create a pressure inside said space which is lower than a pressure in front of said first and second airfoils so that said overspray is sucked into and through said space into said airblast assembly inlet.

23. A power broom assembly according to claim 22, further including:

means for moving said partial cover toward and away from said broom to adjust the distance between said first and second airfoils.

24. A power broom assembly according to claim 23, wherein said means for moving said partial cover includes at least one crank assembly rotatably mounted to the front of said power broom assembly and to said partial cover.

25. A power broom assembly, comprising:

a power driven broom; and a drive system for driving the power driven broom comprising:

first and second transmission units adjacent a central portion of the power broom assembly, wherein said first transmission unit includes an input shaft and two output shafts, a first output shaft of said first transmission unit being drivingly connected to an airblast assembly of said power broom assembly and a second output shaft of said first transmission unit being drivingly connected to said second transmission unit to act as an input shaft of said second transmission unit, and wherein said second transmission unit also includes an output shaft drivingly connected to said broom of said power broom assembly, at least said first and second output shafts of said first transmission unit being substantially aligned along a single axis.

26. A power broom assembly according to claim 25, further including:

an engine, wherein said input shaft of said first transmission unit is spaced vertically from an output shaft of said engine by only a relatively small distance.

27. A power broom assembly according to claim 25, further including:

a first airfoil mounted to the front of said power broom assembly near the surface of said broom;

a partial cover surrounding an upper portion of said broom; and a second airfoil on said partial cover, wherein an inlet of an airblast assembly opens into a space between said broom and said partial cover, and said first and second airfoils cooperate to create a pressure inside said space which is lower than a pressure in front of said first and second airfoils so that said overspray is sucked into and through said space into said airblast assembly inlet.

28. A power broom assembly according to claim 27, further including:

means for moving said partial cover toward and away from said broom to adjust the distance between said first and second airfoils.

29. A power broom assembly according to claim 28, wherein said means for moving said partial cover includes at least one crank assembly rotatably mounted to the front of said power broom assembly and to said partial cover.

30. A power broom assembly, comprising:

a vehicle for movement in a first direction;

a rotatable broom rotatably mounted to a front of said vehicle; and an airblast assembly mounted to the front of said vehicle above said broom to generate an air flow and suck up overspray of material which has been swept up by said broom, said air blast assembly being connected to at least one outlet, and said at least one outlet having an outlet opening located near the ground ahead of wheels of said vehicle and oriented to direct air and any entrained overspray ahead, in said first direction, of said wheels of said vehicle to maintain a clear path ahead of said wheels.

* * * * *